United States Patent [19]

Yamashita

[11] Patent Number: 5,056,403

[45] Date of Patent: Oct. 15, 1991

[54] ELECTRONIC DRUM WITH VIBRATION ISOLATING HEAD

[75] Inventor: Toshinori Yamashita, Hamamatsu, Japan

[73] Assignee: Yamaha Corporation, Shizuoka, Japan

[21] Appl. No.: 526,700

[22] Filed: May 15, 1990

Related U.S. Application Data

[63] Continuation of Ser. No. 338,348, Apr. 12, 1989, abandoned, which is a continuation of Ser. No. 108,092, Oct. 13, 1987, abandoned.

[30] Foreign Application Priority Data

Oct. 14, 1986 [JP] Japan ..... 61-156058[U]

[51] Int. Cl.[5] ..... G10H 1/32; G10H 3/12

[52] U.S. Cl. ..... 84/723; 84/743; 84/DIG. 12

[58] Field of Search ..... 84/723, 725, 730, 733, 84/734, 743, 411 R, 411 A, 411 M, 411 P, DIG. 12, DIG. 24

[56] References Cited

U.S. PATENT DOCUMENTS

| | | | |
|---|---|---|---|
| 4,279,188 | 7/1981 | Scott | 84/DIG. 12 X |
| 4,356,757 | 11/1982 | Mooy | 84/411 R |
| 4,479,412 | 10/1984 | Klynas | 84/DIG. 12 X |
| 4,581,972 | 4/1986 | Hoshino | 84/DIG. 12 X |
| 4,581,973 | 4/1986 | Hoshino | 84/DIG. 12 X |
| 4,589,323 | 5/1986 | Belli et al. | 84/411 M |
| 4,648,302 | 3/1987 | Bozzio | 84/1.06 X |
| 4,669,349 | 6/1987 | Hyakutake | 84/DIG. 24 X |
| 4,679,479 | 7/1987 | Koyamoto | 84/DIG. 24 X |
| 4,700,602 | 10/1987 | Bozzio | 84/DIG. 12 X |
| 4,732,070 | 3/1988 | Yamashita | 84/DIG. 12 X |

FOREIGN PATENT DOCUMENTS

| | | | |
|---|---|---|---|
| 55-97792 | 7/1980 | Japan . | |
| 0113070 | 8/1983 | Japan . | |
| 59-39753 | 11/1984 | Japan . | |
| 2161973 | 1/1986 | United Kingdom | 84/411 M |

*Primary Examiner*—Stanley J. Witkowski

*Attorney, Agent, or Firm*—Blakely, Sokoloff, Taylor & Zafman

[57] ABSTRACT

According to this invention, an electronic drum has a head portion. An annular frame is arranged to generally surround the head portion. A vibration plate is arranged to be in tight contact with a lower surface of the head portion, and vibrates in response to the performer's strike of the head portion. A pickup device is mounted on the vibration plate so as to detect the vibration of the vibration plate. A vibration preventing portion is inserted between the head portion and the annular frame so as to prevent the vibration from being transmitted to the annular frame. The head portion and the vibration preventing portion are integrally formed of a flexible material. A sound device is connected to the pickup device so as to produce a drum sound in response to the detected vibration.

11 Claims, 3 Drawing Sheets

ELECTRONIC DRUM WITH VIBRATION ISOLATING HEAD

This is a continuation of application Ser. No. 338,348, filed Apr. 12, 1989, now abandoned, which is a continuation of application Ser. No. 108,092, filed Oct. 13, 1987, now abandoned.

BACKGROUND OF THE INVENTION

The present invention relates to an electronic drum.

In a conventional electronic drum, a drum head or a pad is struck by a stick, and a vibration caused thereby is converted into an electrical signal. A musical tone (electronic tone) generating operation of an electronic tone source apparatus (such as a PCM tone source or an FM tone source) is controlled by waveform information of the electrical signal (striking position as a function of time, tone volume, and the like), thereby generating an electronic tone from a loudspeaker. In particular, the electronic drum must satisfy the following requirements: even if any portion of the drum head or pad is struck, the output (i.e., sensitivity) from a pickup device must be uniform; a change in signal in accordance with a change in striking force coincides with feeling of a performer; and a stick feeling must resemble that of an acoustic drum. Therefore, the material of the drum head and its mounting structure determine the performance of the electronic drum. Various drum heads have beer proposed, and for example, Japanese Utility Model Publication No. 59-39753, Japanese Utility Model Laid-Open Nos. 55-97792 and 58-113070 are known.

However, in an electronic percussion disclosed in Japanese Utility Model Publication No. 59-39753, outer peripheral portions of two vibration films are bonded to each other, and a cushion member and a pickup device are arranged between the vibration films to constitute a drum head. Therefore, a means for supporting and tensing the drum head is necessary as in an acoustic drum, resulting in a complicated structure and poor handling. In addition, sensitivity variation occurs depending on striking positions. In an electronic percussion disclosed in Japanese Utility Model Laid-Open No. 55-97792, a reception member is disposed in an opening of a cylindrical body, a cushion material is placed on the reception member, and the cushion material is covered with a striking film. However, with this electronic percussion, the striking film must be supported and tensed at a predetermined tensile force. Therefore, the structure is complicated, and sensitivity variation occurs as in the above mentioned electronic percussion.

In a snare drum trainer disclosed in Japanese Utility Model Laid-Open No. 58-113070, a foamed member is disposed on the surface of a base, and a dummy head is adhered thereon. With this structure, although good stick feeling can be obtained, it is nothing but a trainer, and cannot be satisfactorily used for performance.

As another conventional apparatus, the following electronic drum is known. More specifically, as shown in FIG. 4, a drum head 1 is tensed on a cylindrical body 2 by a known support/tension means 3, and a cushion member 5 is arranged between the drum head 1 and an intermediate plate 4. A dynamic loudspeaker 6 as a microphone is mounted on the lower surface of the intermediate plate 4. With this electronic drum, stick feeling can resemble that of the acoustic drum. However, since the electronic drum of this type has poor high-frequency characteristics, a delicate stick work cannot be easily detected. In addition, since the loudspeaker 6 has a large thickness, the thickness of the drum is inevitably increased. It is therefore difficult to realize a low-profile electronic drum.

SUMMARY OF THE INVENTION

It is an object of the present invention to provide an electronic drum which has a simple structure, and can eliminate a sensitivity variation depending on striking positions, and has good stick feeling.

In order to achieve the above object, there is provided an electronic drum comprising: a head portion to be struck by a performer; an annular frame arranged to generally surround the head portion; a vibration plate, arranged to be in tight contact with a lower surface of the head portion, for vibrating in response to the performer's strike of the head portion; a pickup device, mounted on the vibration plate, for detecting the vibration of the vibration plate; vibration preventing means, inserted between the head portion and the annular frame, for preventing the vibration from being transmitted to the annular frame, wherein the head portion and the vibration preventing means are integrally formed of a flexible material; and a sound device connected to the pickup device for sounding in response to the detected vibration.

DESCRIPTION OF THE PREFERRED EMBODIMENT

An embodiment of the present invention will now be described with reference to the accompanying drawings.

Figure 1:
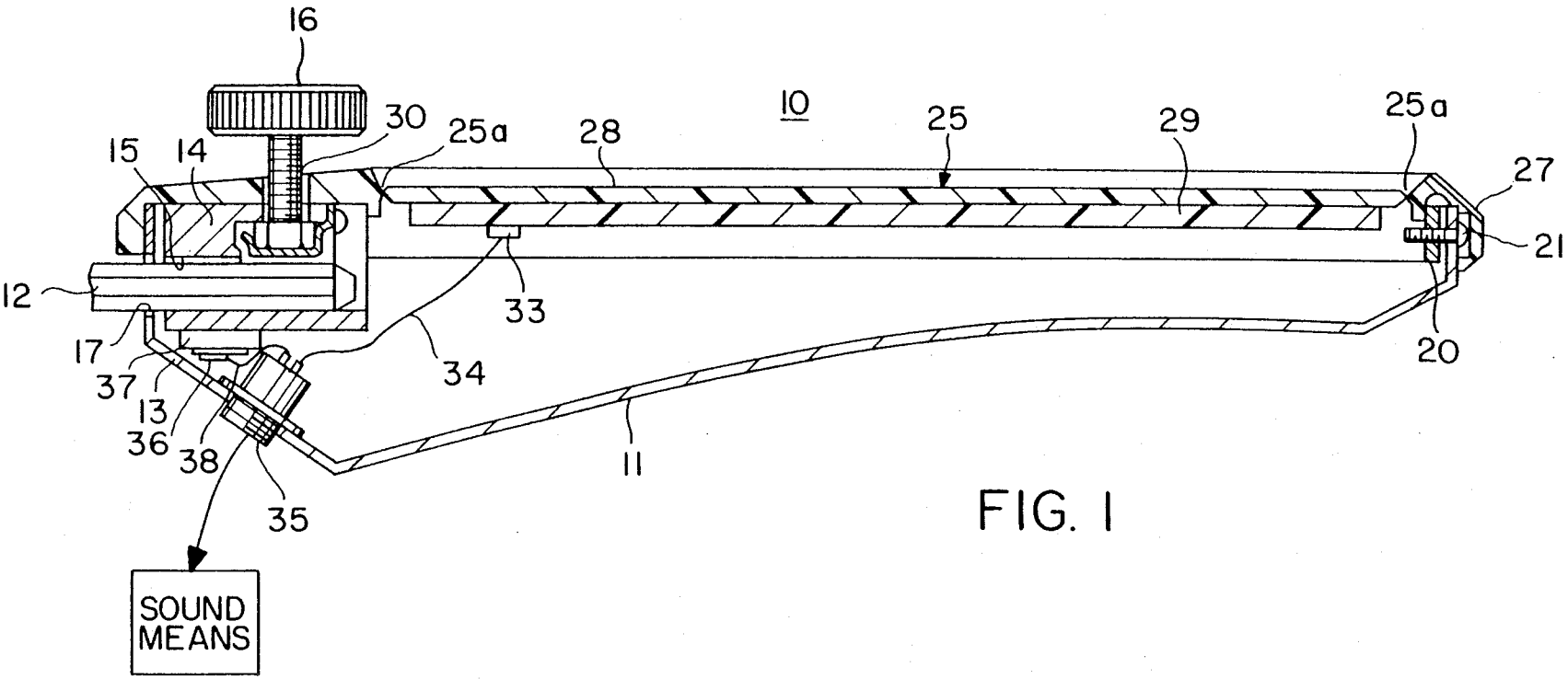
FIG. 1 is a longitudinal sectional view showing an electronic drum according to an embodiment of the present invention.
Figure 2:
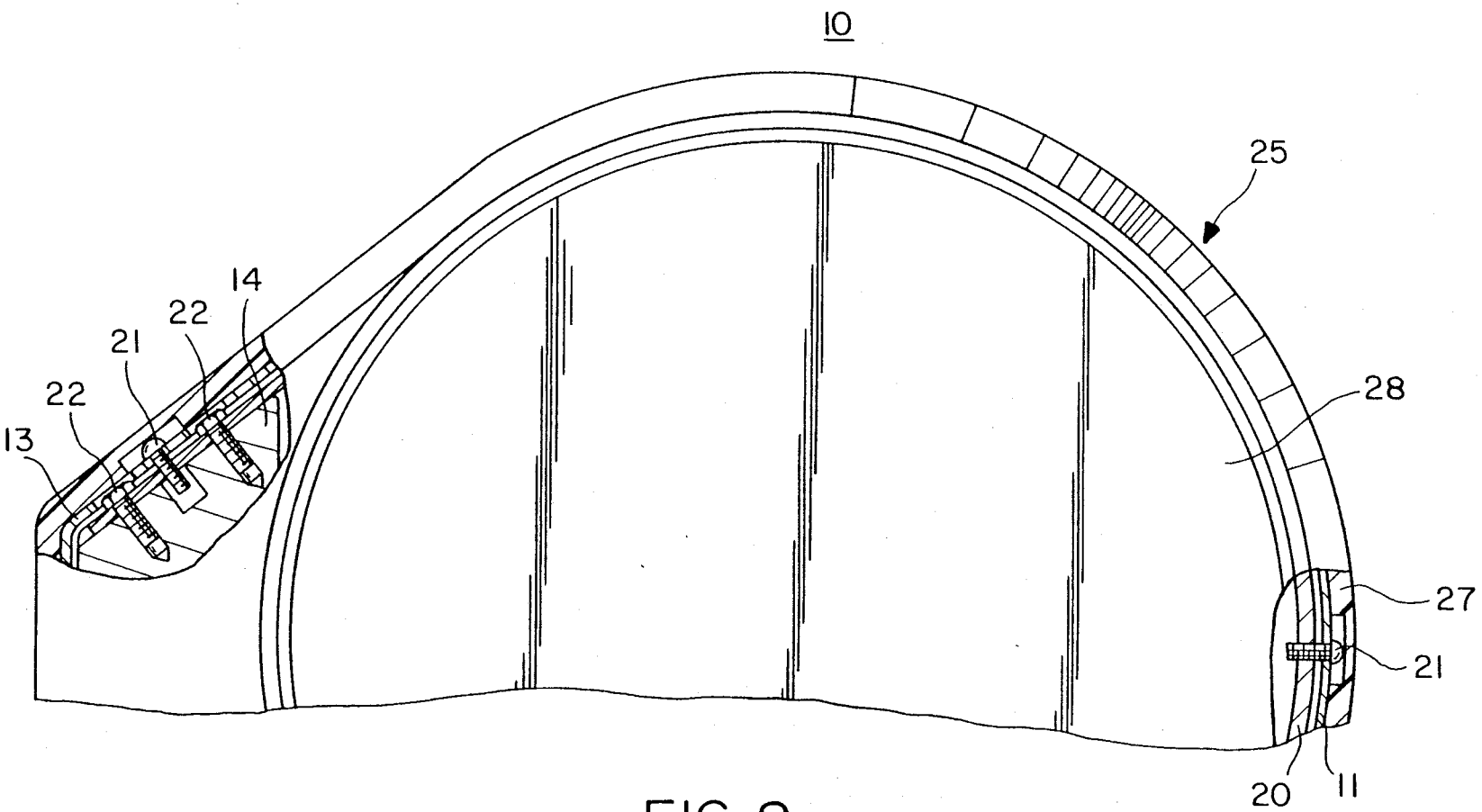
FIG. 2 is a partially cutaway plan view of the electronic drum shown in FIG. 1.

FIGS. 1 and 2 show an electronic drum according to an embodiment of the present invention. Referring to FIGS. 1 and 2, an electronic drum 10 comprises a substantially circular instrument case 11 with a shallow bottom. The case 11 has an upper opening. The instrument case 11 is formed of a plastic or metal plate. A portion the periphery of the case 11 projects in the radial direction in a substantially trapezoidal shape, thus constituting a mounting portion 13 for an instrument support rod 12 of an instrument stand (not shown). The rod 12 normally has a polygonal shape, and facilitates fixing by a bolt (to be described later). A metal holder 14 for fixing the electronic drum 10 to the rod 12 is arranged and fixed inside the mounting portion 13. The holder 14 has a rod insertion hole 15 receiving the rod 12, and a tightening bolt 16 for pressing the rod 12 against the inner surface of the insertion hole 15 and fixing it. A hole 17 is formed in the mounting portion 13 in correspondence with the rod insertion hole 15. Note that a nut is threadably engaged with and fixed to the distal end of the bolt 16, and that the outer surface of the nut is covered with a washer which is partially fixed to the holder 14, so that the rod 12 is fixed by the bolt 16 through the washer.

A substantially annular frame 20 of a metal such as aluminum which is cut and open at the mounting portion 13 is fitted in the inner surface of the upper opening of the instrument case 11 and is fixed thereto by a plurality of set screws 21. The holder 14 is fixed to the inner surface of the open end portion of the annular frame 20 by a plurality of set screws 22. A pad cover 25 formed of a flexible material such as rubber is covered on the upper opening portion of the instrument case 11, and covers the opening portion and the holder 14. A fitting holder 27 having a substantially inverted U shape is integrally formed on the peripheral portion of the pad cover 25, and is fitted on the end of opening of the instrument case 11 and the annular frame 20 from the above. A vibration plate 29 has a smaller diameter than an inner diameter of the annular frame 20 and a proper thickness and is formed of a synthetic resin, wood, or the like. The vibration plate 29 is fixed to the inner surface of a head portion 28 which is struck by a stick. The head portion 28 in tight contact with the vibration plate 29 has a thin boundary portion or vibration preventing portion 25*a* on its peripheral portion so as to prevent transmission of its vibration to the surrounding portion when it is struck and so as to be supported by the surrounding portion. Therefore, the head portion 28 is spatially separated from other portions and hence, has a floating structure. A bolt insertion hole 30 through which the tightening bolt 16 extends is formed in the head portion 28 in correspondence with the tightening bolt 16 for the pad cover 25. A first pickup device 33 for picking up the vibration of the vibration plate 29 and converting it into an electrical signal is fixed to a proper portion of the lower surface of the vibration plate 29. A lead wire 34 of the pickup device 33 is connected to a jack 35 extending through the wall of the instrument case 11. The jack 35 is connected to a sound means through wires. The sound means produces a drum sound when the head portion 28 is struck by the stick.

A second pickup device 36 is mounted on the lower surface of the holder 14 through a cushion 37. The second pickup device 36 is arranged to detect a vibration of the holder 14 upon a rim shot, and is connected to another jack (not shown) by a lead wire 38. In this case, the second pickup device 36 need not always be mounted on the holder 14 but may be fixed to the inner surface of the instrument case 11 through the cushion 37 to detect the vibration of the case 11 upon a rim shot.

In the electronic drum 10 with the above structure, the head portion 28 of the pad cover 25 has the complete floating structure, and is vibrated together with the vibration plate 29 upon striking. Since the head portion 28 is coupled to the surrounding portion other than the head portion 28 through only the vibration preventing portion 25*a*, the striking vibration is satisfactorily transmitted to the entire vibration plate 29 in tight contact with the head portion 28 and is averaged. Therefore, the vibration preventing portion 25*a* can cause the head portion 28 to be spatially separated from the surrounding portion, and hence, can prevent a striking vibration from being transmitted to an external portion from the vibration preventing portion 25*a*. Since the floating structure is adopted, a stick feeling resembling striking of a drum head of an acoustic drum can be obtained. In addition, when the peripheral edge portion of the pad cover 25, i.e., the fitting holder 27 is struck, the vibration caused thereby is transmitted to the cushion member 37 through the instrument case 11 and the holder 14, and is detected by the second pickup device 36. The detected vibration is converted into an electrical signal, and can be positively produced as a rim shot tone.

In the case of a drum, a plurality of pads are often used. When the head portion 28 of the pad cover 25 adopts the floating structure, if one pad is struck, other pads are not influenced thereby, and tone separation can be improved.

Figure 3:
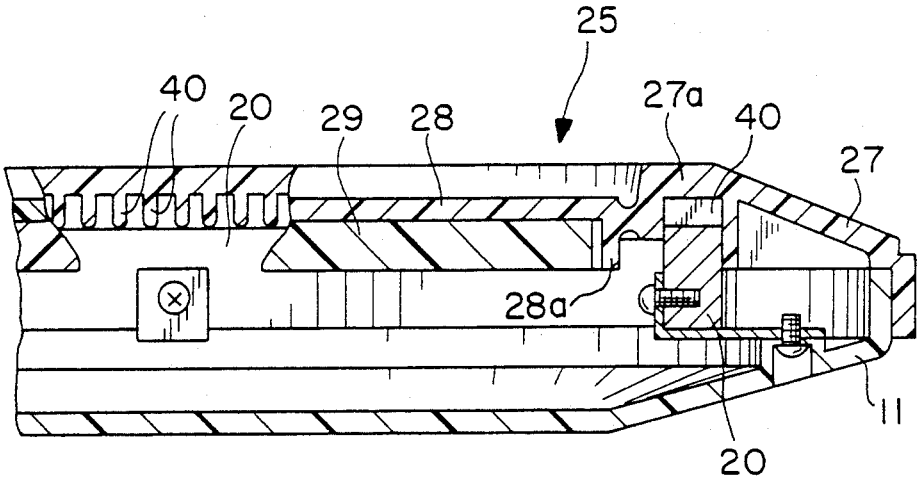
FIG. 3 is a partial sectional view of an electronic drum according to a modification of the embodiment shown in FIG. 1.
Figure 4:
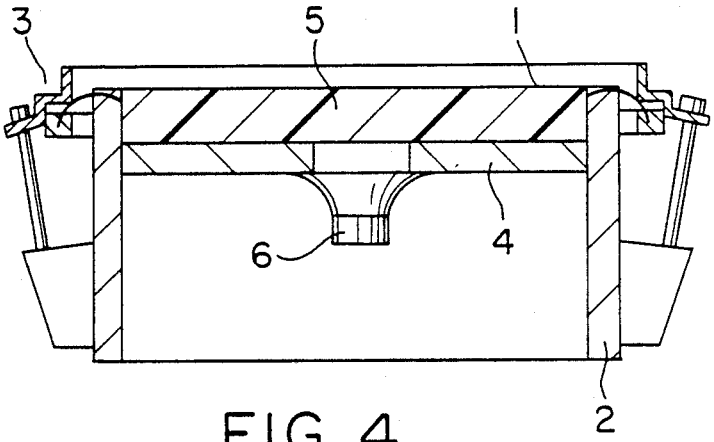
FIG. 4 (PRIOR ART)
FIG. 4 is a sectional view showing a conventional electronic drum.

The present invention is not limited to the above embodiment, and various applications and modifications may be made within spirit of the invention. FIG. 3 shows a modification of the present invention. The same reference numerals in this modification denote the parts having the same functions as in FIG. 1. Referring to FIG. 3, a large number of recesses 40 are formed along the circumferential direction of a peripheral edge portion 27*a* of the pad cover 25 placed on the annular frame 20. With these recesses 40, the contacting area between the peripheral edge portion 27*a* and the annular frame 20 is reduced, so that a performer can obtain a soft rim-shot touch, thereby improving the stick feeling. Head portion 28 may also include annular rib 28*a* at its outer periphery.

As described above, in the electronic drum of the present invention, an upper opening of the instrument case is covered by a pad cover of a flexible material, the head portion of the cover has a floating structure, and a vibration plate having a pickup device is mounted on the lower surface of the head portion. Therefore, a striking vibration transmitted to the vibration plate through the pad cover can be averaged by the vibration of the head portion, and a sensitivity variation depending on the striking positions can be eliminated and prevented. In addition, a stick feeling can be controlled by changing the thickness and hardness of the pad cover or the hardness of the vibration plate.

What is claimed is:

1. An electronic drum comprising:

a head portion to be struck by a performer;

a pad cover integrated with said head portion and covering an upper portion of said electronic drum;

an annular frame arranged to generally surround said head portion;

a vibration plate arranged to be in tight contact with a lower surface of said head portion for vibrating spatially in response to said performer's strike of said head portion;

a vibration preventing means provided between said head portion and said pad cover for preventing vibration of said vibration plate from being transmitted to said annular frame;

a pickup device mounted on said vibration plate for detecting vibrations of said vibration plate; and a sound device connected to said pickup device for sounding in response to the detected vibration;

said head portion and said cover being made of a flexible material to form a unitary piece;

said pad cover being fitted over said frame to support said head portion.

2. An electronic drum according to claim 1, wherein said annular frame is made of metal.

3. An electronic drum according to claim 1, further comprising an instrument case to which said annular frame is fitted.

4. An electronic drum according to claim 1, further comprising a second pickup device connected to said annular frame, for detecting a rim shot.

5. An electronic drum according to claim 4, wherein said second pickup device is inserted through a cushion member and mounted to a holder connected to said annular frame.

6. An electric drum comprising;

an instrument case having an upper opening;

a pad cover formed of a flexible material covering an upper surface of said instrument case;

said pad cover including a head portion to be struck by a performer and integrally formed with said head portion;

an annular frame portion which surrounds said head portion, said pad cover extending to the outside of said frame;

a thin boundary portion between said head portion and said annular frame portion for preventing vibration of said head portion from being transmitted to said annular frame portion;

a vibration plate, mounted on a lower surface of said head portion for vibrating spatially in response to said performer's strike;

a pickup device mounted on said vibration plate for detecting vibration of said vibration plate; and a sound device connected to said pickup device for sounding in response to the detected vibration.

7. An electronic drum according to claim 6, further comprising a frame which is arranged on a lower surface of said annular frame and is fixed to said instrument case.

8. An electronic drum according to claim 7, further comprising recesses which are formed on said lower surface of said annular surface, thereby reducing the contact area between said pad cover and said annular frame.

9. An electronic drum according to claim 6, further comprising second pickup device for detecting second vibration generated when said pad cover other than said head portion is struck thereby detecting a rim shot.

10. An electronic drum according to claim 6, wherein said head portion of said pad cover includes an annular rib adjacent to said thin boundary portion.

11. An electronic drum according to claim 9, wherein said pad cover includes a peripheral edge portion integrally formed with said head portion.

* * * * *

UNITED STATES PATENT AND TRADEMARK OFFICE

CERTIFICATE OF CORRECTION

PATENT NO. : 5,056,403

DATED : October 15, 1991

INVENTOR(S) : Toshinori Yamashita

It is certified that error appears in the above-indentified patent and that said Letters Patent is hereby corrected as shown below:

Col. 1, line 30, change "beer" to --been--;

Col. 2, line 50, after "portion" insert --of--.

Signed and Sealed this

Second Day of May, 1995

*Attest:*

*Attesting Officer*

BRUCE LEHMAN

*Commissioner of Patents and Trademarks*